US006729400B2

(12) United States Patent
Mullins et al.

(10) Patent No.: US 6,729,400 B2
(45) Date of Patent: May 4, 2004

(54) METHOD FOR VALIDATING A DOWNHOLE CONNATE WATER SAMPLE

(75) Inventors: Oliver C. Mullins, Ridgefield, CT (US); Michael Hodder, Aberdeen (GB); Cosan Ayan, Houston, TX (US); Yifu Zhu, Miami, FL (US); Phillip Rabbito, Milford, CT (US)

(73) Assignees: Schlumberger Technology Corporation, Ridgefield, CT (US); M-I L.L.C., Houston, TX (US)

( * ) Notice: Subject to any disclaimer, the term of this patent is extended or adjusted under 35 U.S.C. 154(b) by 0 days.

(21) Appl. No.: 10/305,878

(22) Filed: Nov. 27, 2002

(65) Prior Publication Data

US 2003/0145988 A1 Aug. 7, 2003

Related U.S. Application Data

(60) Provisional application No. 60/333,890, filed on Nov. 28, 2001.

(51) Int. Cl.[7] ..... E21B 49/08

(52) U.S. Cl. ..... 166/264; 166/66; 166/250.01

(58) Field of Search ..... 166/165, 166, 166/65.1, 373, 264, 66, 250.01

(56) References Cited

U.S. PATENT DOCUMENTS

| | | | | | |
|---|---|---|---|---|---|
| 3,780,575 | A | | 12/1973 | Urbanosky | 73/152 |
| 3,813,936 | A | | 6/1974 | Urbanosky et al. | 73/155 |
| 3,859,851 | A | | 1/1975 | Urbanosky | 73/155 |
| 4,716,973 | A | * | 1/1988 | Cobern | 175/50 |
| 4,860,581 | A | | 8/1989 | Zimmerman et al. | 73/155 |
| 4,936,139 | A | | 6/1990 | Zimmerman et al. | 73/155 |
| 4,994,671 | A | | 2/1991 | Safinya et al. | 250/255 |
| 5,266,800 | A | | 11/1993 | Mullins | 250/256 |
| 5,289,875 | A | * | 3/1994 | Stokley et al. | 166/264 |
| 5,335,542 | A | * | 8/1994 | Ramakrishnan et al. | 73/152.08 |
| 5,355,088 | A | * | 10/1994 | Howard, Jr. | 324/339 |
| 5,859,430 | A | | 1/1999 | Mullins et al. | 250/255 |
| 5,902,939 | A | * | 5/1999 | Ballard et al. | 73/863.12 |
| 6,092,416 | A | | 7/2000 | Halford et al. | 73/152.23 |
| 6,125,934 | A | | 10/2000 | Lenn et al. | 166/250.12 |
| 6,131,451 | A | | 10/2000 | Izbicki et al. | 73/152.18 |
| 6,274,865 | B1 | | 8/2001 | Schroer et al. | 250/269.1 |
| 6,343,507 | B1 | * | 2/2002 | Felling et al. | 73/152.19 |
| 6,557,632 | B2 | * | 5/2003 | Cernosek | 166/264 |

FOREIGN PATENT DOCUMENTS

| | | | |
|---|---|---|---|
| GB | 2 288 618 | 10/1995 | E21B/49/10 |
| GB | 2 355 033 | 11/2001 | E21B/49/08 |

* cited by examiner

*Primary Examiner*—Frank Tsay
(74) *Attorney, Agent, or Firm*—John L. Lee; William B. Batzer; John J. Ryberg

(57) ABSTRACT

A downhole connate water sample drawn from the formation surrounding a well is validated when mud filtrate concentration is acceptably low. A preferred method includes drilling the well with a water-based drilling fluid, or more generally a water-based mud (WBM), containing a water-soluble dye. The dye acts as a tracer to distinguish connate water from WBM filtrate in a downhole sample of formation fluid contaminated by mud filtrate from the water-based mud. Preferably, an optical analyzer in a sampling tool measures light transmitted through the downhole sample to produce optical density data indicative of dye concentration. Preferably, optical density is measured at a first wavelength to obtain a first optical density, and at a second wavelength, close in wavelength to the first wavelength, to obtain a second optical density. First and second optical density data are transmitted to the surface. At the surface, in a data processor, the second optical density is subtracted from the first optical density to produce a third optical density that is substantially free of scattering error. The data processor validates each sample that has an acceptably low third optical density. The invention also provides a method of determining when to collect a sample of downhole fluid drawn over a period of time from a formation surrounding a well.

18 Claims, 3 Drawing Sheets

METHOD FOR VALIDATING A DOWNHOLE CONNATE WATER SAMPLE

This application claims priority from co-pending U.S. Provisional Application No. 60/333,890 filed Nov. 28, 2001. This application is also related to co-owned U.S. Pat. Nos. 3,780,575 and 3,859,851 to Urbanosky, co-owned U.S. Pat. Nos. 4,860,581 and 4,936,139 to Zimmerman et al., co-owned U.S. Pat. No. 4,994,671 to Safinya et al., co-owned U.S. Pat. Nos. 5,266,800 and 5,859,430 to Mullins, co-owned U.S. Pat. No. 6,274,865 to Shroer et al., and co-owned, co-pending U.S. application Ser. No. 09/300,190, filed May 25, 2000.

FIELD OF THE INVENTION

The present invention relates to the analysis of downhole fluids in a geological formation. More particularly, the invention relates to methods for validating a downhole formation fluid sample.

BACKGROUND OF THE INVENTION

Schlumberger Technology Corporation, the assignee of this application, has provided a commercially successful borehole tool, the Modular Formation Dynamics Tester (MDT), which extracts and analyzes a flow stream of fluid from a formation in a manner substantially as set forth in co-owned U.S. Pat. Nos. 3,859,851 and 3,780,575 to Urbanosky. MDT is a trademark of Schlumberger. The Optical Fluid Analyzer (OFA), a component module of the MDT, determines the identity of the fluids in the MDT flow stream OFA is a trademark of Schlumberger.

Safinya, in U.S. Pat. No. 4,994,671, discloses a borehole apparatus which includes a testing chamber, means for directing a sample of fluid into the chamber, a light source preferably emitting near infrared rays and visible light, a spectral detector, a data base means, and a processing means. Fluids drawn from the formation into the testing chamber are analyzed by directing the light at the fluids, detecting the spectrum of the transmitted and/or back-scattered light, and processing the information accordingly. Prior art equipment is shown in FIGS. 1A–1C of U.S. Pat. No. 6,274,865-B1.

Because different fluid samples absorb energy differently, the fraction of incident light absorbed per unit of path length in the sample depends on the composition of the sample and the wavelength of the light. Thus, the amount of absorption as a function of the wavelength of the light, hereinafter referred to as the "absorption spectrum", has been used in the past as an indicator of the composition of the sample. For example, Safinya teaches that the absorption spectrum in the wavelength range of 0.3 to 2.5 microns can be used to analyze the composition of a fluid containing oil. The disclosed technique fits a plurality of data base spectra related to a plurality of oils and to water, etc., to the obtained absorption spectrum in order to determine the amounts of different oils and water that are present in the sample.

When the desired fluid is identified as flowing in the MDT, sample capture can begin and formation oil can be properly analyzed to determine important fluid properties needed to assess the economic value of the reserve, and to set various production parameters.

Mullins, in co-owned U.S. Pat. No. 5,266,800, teaches to distinguish formation oil from oil-based mud filtrate (OBM filtrate) by measuring OBM filtrate contamination using a coloration technique. By monitoring UV optical absorption spectrum of fluid samples obtained over time, a real time determination is made as to whether a formation oil is being obtained as opposed to OBM filtrate. Mullins discloses how the coloration of crude oils can be represented by a single parameter that varies over several orders of magnitude. The OFA was modified to include particular sensitivity towards the measurement of crude oil coloration, and thus OBM filtrate coloration. During initial extraction of fluid from the formation, OBM filtrate is present in relatively high concentration. Over time, as extraction proceeds, the OBM filtrate fraction declines and crude oil becomes predominant in the MDT flow line. Using coloration, as described in U.S. Pat. No. 5,266,800, this transition from contaminated to uncontaminated flow of crude oil can be monitored.

Shroer, in U.S. Pat. No. 6,274,865-B1, and in co-owned, co-pending U.S. application Ser. No. 09/300,190, teaches that the measured optical density of a downhole formation fluid sample contaminated by OBM filtrate changes slowly over time and approaches an asymptotic value corresponding to the true optical density of formation fluid. He further teaches the use of a real time log of OBM filtrate fraction to estimate OBM filtrate fraction by measuring optical density values at one or more frequencies, curve fitting to solve for an asymptotic value, and using the asymptotic value to calculate OBM filtrate fraction. He further teaches to predict future filtrate fraction as continued pumping flushes the region around the MDT substantially free of OBM filtrate. Thus, coloration can be used to distinguish crude oil from oil-based mud filtrate, current OBM filtrate fraction can be determined, and future OBM filtrate fraction can be predicted.

Tracers have been used previously in support of measurements carried out at the surface. Carrying samples to the surface for measurement has two disadvantages. First, there is the risk that the sample may be too contaminated to be of use, in which case the sampling process would have to be repeated. Second, if the sample is suitable for use, additional time may have been wasted flushing the sampling tool when earlier samples would have been good enough.

U.S. Pat. Nos. 3,780,575 and 3,859,851 to Urbanosky, U.S. Pat. Nos. 4,860,581 and 4,936,139 to Zimmerman et al., U.S. Pat. No. 4,994,671 to Safinya et al., U.S. Pat. Nos. 5,266,800 and 5,859,430 to Mullins, U.S. Pat. No. 6,274,865-B1 to Shroer et al., and U.S. application Ser. No. 09/300,190 are hereby incorporated herein by reference.

SUMMARY OF THE INVENTION

The invention provides a method for validating a downhole connate water sample drawn from formation surrounding a well, comprising: drilling the well with a water-based mud containing a water-soluble dye; obtaining a sample of formation fluid downhole; measuring optical density of the sample downhole; and validating the sample if sample optical density is acceptably low.

The invention provides a method for validating a downhole connate water sample in a well, comprising the acts of: (a) drilling the well with a water-based mud containing a water-soluble dye; (b) obtaining a sample of formation fluid downhole; (c) measuring optical density of the sample downhole; (d) repeating acts (b) and (c) to obtain optical density from each of a series of samples; and (e) validating a sample if sample optical density is acceptably low.

The invention provides a method for validating a downhole connate water sample drawn from formation surrounding a well, comprising: drilling the well with a water-based mud; obtaining a sample of formation fluid downhole; measuring at least one characteristic of downhole fluid indicative of water-based mud filtrate contamination levels in the sample; and validating the sample if the at least one measured characteristic is acceptably low.

The invention provides a method of determining when to collect a sample of downhole fluid drawn from a formation surrounding a well, comprising: measuring at least one characteristic of downhole fluid indicative of water-based mud filtrate contamination levels in downhole fluid drawn from a formation surrounding the well over a period of time; and using said measurements to determine when to collect a sample of said downhole fluid.

DETAILED DESCRIPTION OF THE INVENTION

Measuring WBM Filtrate Concentration using Dye Tracer and Optical Density

Figure 1:
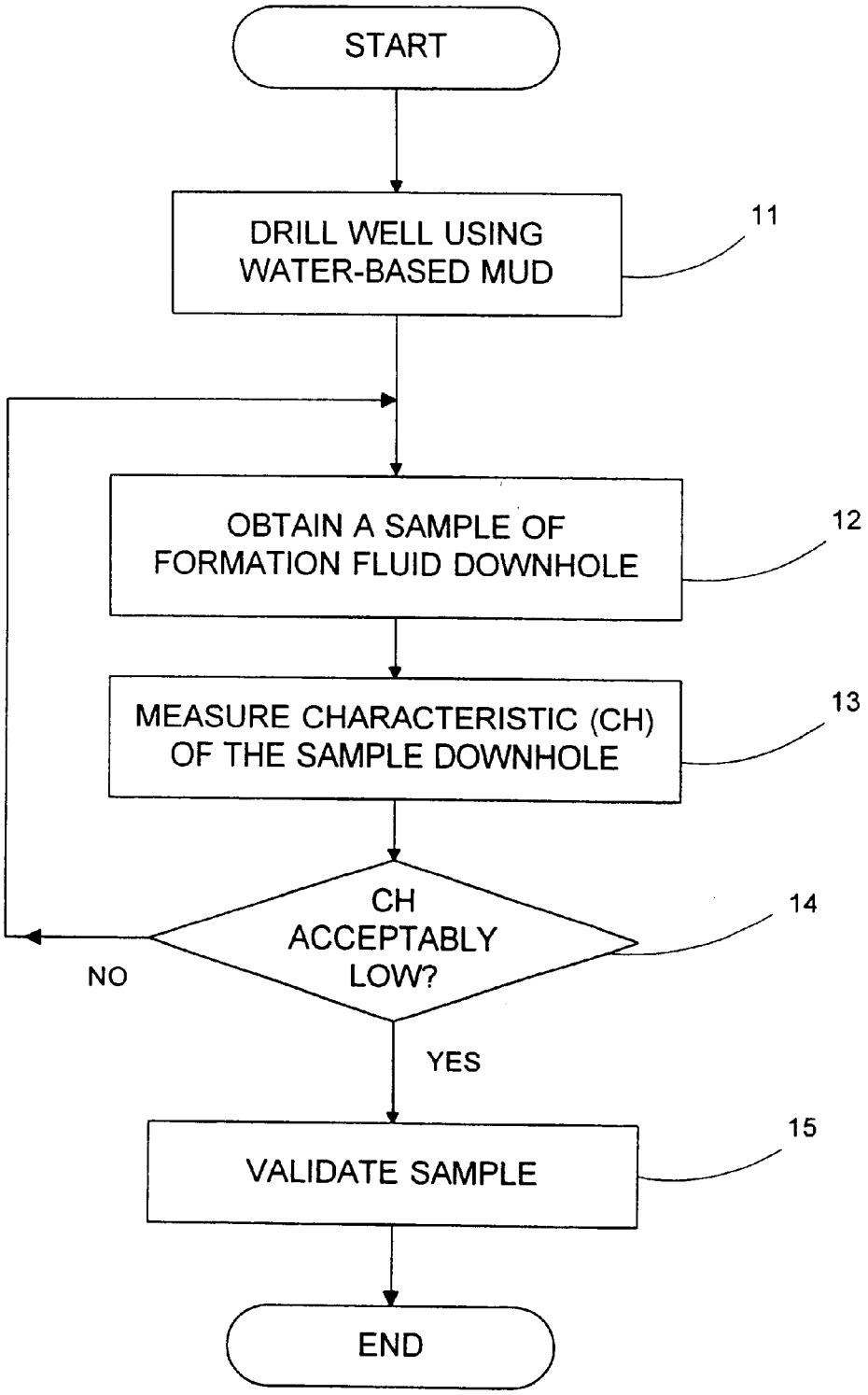
FIG. 1 illustrates the method of the present invention.
Figure 2:
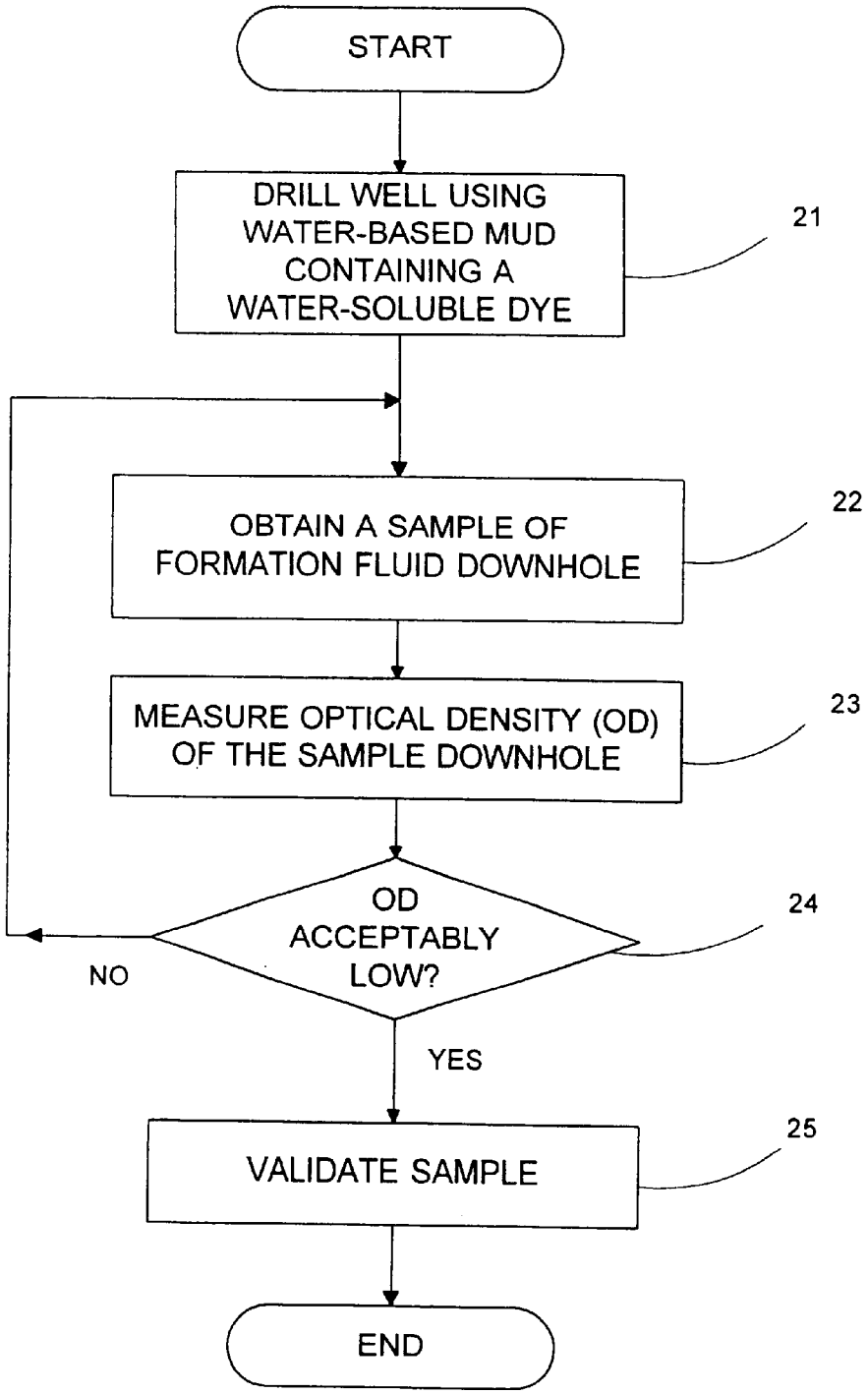
FIG. 2 illustrates the method of the preferred embodiment.

A downhole connate water sample drawn from the formation surrounding a well is validated when mud filtrate concentration is acceptably low. This process is illustrated in FIG. 1. A preferred method includes drilling the well with a water-based drilling fluid, or more generally a water-based mud (WBM), containing a water-soluble dye. The dye acts as a tracer to distinguish connate water from WBM filtrate in a downhole sample of formation fluid contaminated by mud filtrate from the water-based mud. Preferably, an optical analyzer in a sampling tool measures light transmitted through the downhole sample to produce optical density data indicative of dye concentration. This process is illustrated in FIG. 2. Preferably, optical density is measured at a first wavelength to obtain a first optical density, and at a second wavelength, close in wavelength to the first wavelength, to obtain a second optical density. First and second optical density data are transmitted to the surface. At the surface, in a data processor, the second optical density is subtracted from the first optical density to produce a third optical density that is substantially free of scattering error. The data processor validates each sample that has an acceptably low third optical density. The invention also provides a method of determining when to collect a sample of downhole fluid drawn over a period of time from a formation surrounding a well. This process also is illustrated in FIG. 2.

The term "validation" is commonly understood in the oil industry and is used in this application to mean "determination of the suitability of the current downhole sample to be brought to the surface for measurement at the surface of parameters of interest".

Now for the first time, by virtue of the present invention, concentration of WBM filtrate in a downhole sample of connate water can be measured directly, allowing other connate water parameters of interest to be measured downhole and the results transmitted to the surface in the knowledge that the current downhole sample is sufficiently free of WBM filtrate. Accordingly, in context of the present invention, the term "validation" can also mean "determination of validity of retrieved downhole measurement data of connate water parameters of interest, based on the current downhole sample being sufficiently free of WBM filtrate".

In the specification, the appropriate interpretation of "validating a sample" can be understood from the context. In the claims, the term "validating a sample" encompasses both interpretations.

The preferred method of the first embodiment validates downhole measurement data from a downhole connate water sample drawn from the formation surrounding a well drilled using a water-based mud containing a water-soluble blue dye. The method includes repeatedly obtaining a new downhole fluid sample from the formation surrounding the well and measuring the optical density of the sample downhole to obtain an optical density from each of a series of samples; and validating a sample if its optical density is acceptably low. The method may further include measuring optical density at a first wavelength to obtain a first optical density, measuring optical density at a second wavelength, close in wavelength to the first wavelength, to obtain a second optical density, and subtracting the second optical density from the first optical density. The method may further include determining scattering from a series of optical density values, and validating a sample if the scattering is acceptably low. The method may further include calculating from a series of optical density values an asymptotic value indicative of WBM filtrate fraction, and validating a sample if the asymptotic value is stable.

The water-soluble dye, preferably Acid Blue #1 (EMI-600), available from M-I Drilling Fluids, is dissolved in the base fluid (primarily water, sometimes primarily seawater) of the water-based drilling fluid. The sampling tool is preferably a Modular Formation Dynamics Tester (MDT) from Schlumberger. This tool is equipped with an optical fluid analyzer such as the Schlumberger Optical Fluid Analyzer (OFA). The OFA measures optical density in the visible and near-infrared region at various wavelengths between $4\times10^{-7}$ m and $20\times10^{-7}$ m (i.e., between 400 and 2000 nanometers). The sampling tool collects samples of formation fluids, which can either be discarded or kept depending on the level of contamination from drilling fluid filtrate that invaded the rock during the drilling process. Typically the sample flows through the sample cell of the tool and is discarded until the filtrate contamination is reduced to an acceptably low level. The measurement of optical density is carried out downhole during the sampling process, with results in the form of optical density data transmitted to surface for immediate processing. The measurement and the processing processes of the present invention ensure that any measurement data that is retrieved, and any sample that is brought to the surface is of suitable quality. The invention allows the level of filtrate contamination in connate water samples to be determined while the sample is downhole. This immediacy allows the flushing time to be optimized with consequent savings in rig time and operating costs.

Optimizing the flushing time minimizes rig operating costs. It also minimizes the chances of the sampling tool becoming stuck in the hole due to differential pressure (or other mechanism). It also ensures that any sample brought to the surface will be of the required quality for geo-chemical analysis and hence reduces the possibility that the sampling tool may have to be re-run.

The Dye

The dye is selected for compatibility with common water-based drilling fluids and formation (connate) water. The dye must be stable at the expected bottom hole static temperature of the well. The dye should not adversely affect any of the physical properties of the drilling fluid. The dye should also not have any significant surface activity, which might cause it to adsorb onto steel, mineral surfaces, clay solids or weighting agents.

Preferably, a dye is selected for coloring agent whose color closely corresponds to one or more of the wavelengths measured by the selected optical analyzer, for high sensitivity of the measurement. In the preferred embodiment, using Schlumberger Optical Fluid Analyzer (OFA), channel 2 (647 nanometers) responds to Acid Blue #1 (EMI-600).

Dye is added to the drilling fluid to produce a concentration within the range 0.2–2.0 kg/m$^3$ (200–2000 mg/L), and preferably at 2 kg/m$^3$ (2000 mg/L) for highest sensitivity. Assuming that half of the dye will be lost by adhesion to clay in the drilling mud and adhesion to rock in the formation, the effective concentration in the filtrate will be approximately 1 kg/m$^3$ (1000 mg/L). Since the OFA is capable of detecting Acid Blue #1 (EMI-600) in water samples at concentrations as low as 0.01 kg/m$^3$ (10 mg/L), (i.e., 10 ppm by mass because water density is 1 gram/cc), the OFA can measure filtrate contamination levels as low as 1% v/v.

Figure 3:
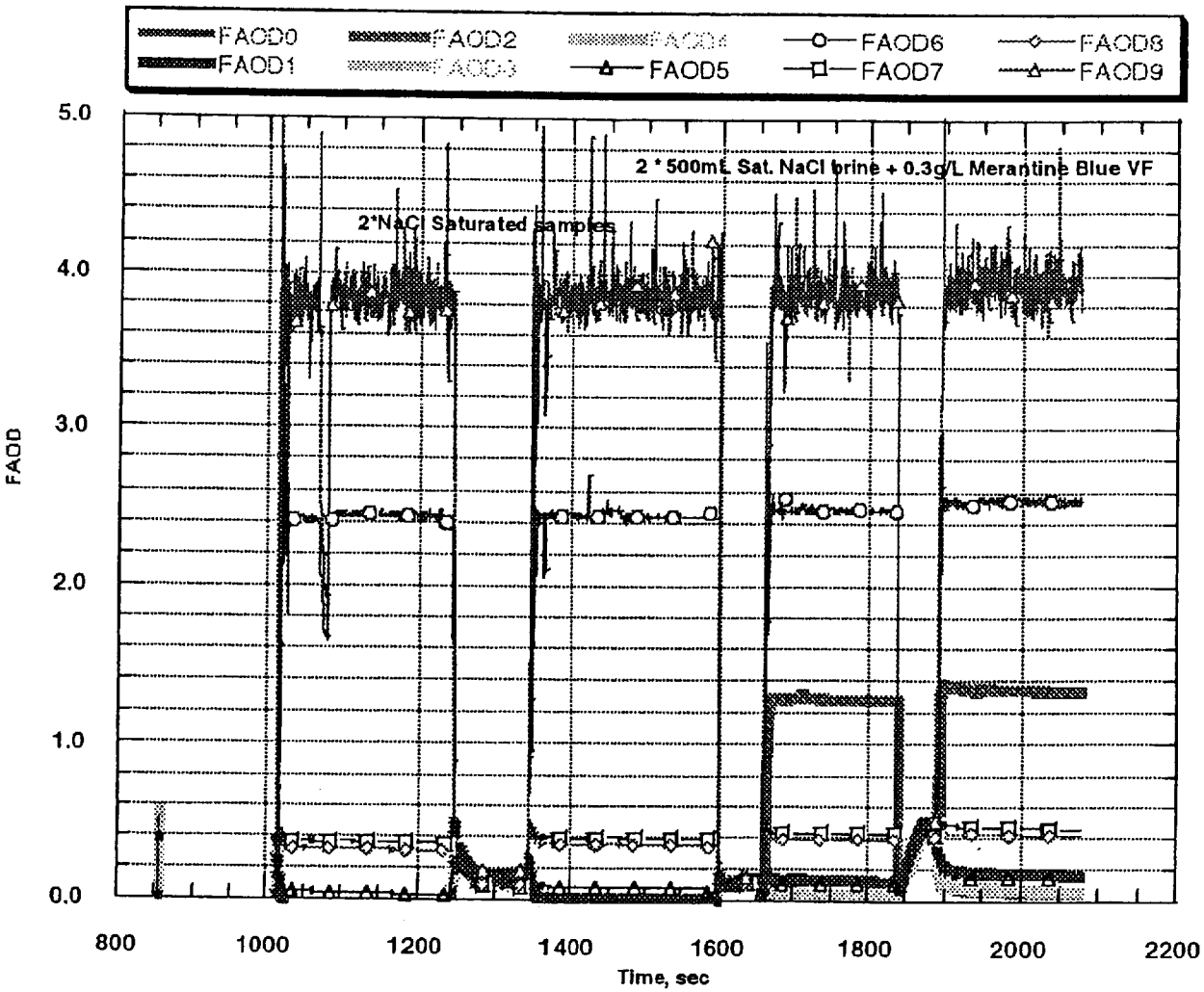
FIG. 3 is a graphical display of optical density on channel FAO2 from a Schlumberger Optical Fluid Analyzer detecting Merantine Blue VF dye in a test of a prototype embodiment of the present invention.

FIG. 3 is a graphical display of optical density on channel FAO2 from a Schlumberger Optical Fluid Analyzer detecting Merantine Blue VF dye in a test of a prototype embodiment of the present invention.

Water-Based Drilling Fluid

Table 1 lists the ingredients of a typical water-based drilling fluid before adding the dye for use in the method of the first embodiment.

TABLE 1

| Product | Function | Concentration |
|---|---|---|
| Seawater | Base fluid | Balance |
| Xanthan gum | Viscosity and suspension | 4.3 kg/m$^3$ |
| Starch | Fluid loss control | 14.3 kg/m$^3$ |
| Sodium chloride | Salinity control | 56 kg/m$^3$ |
| Soda Ash | Alkalinity/calcium control | 0.6 kg/m$^3$ |
| Magnesium oxide | pH buffer and stabiliser | 8.6 kg/m$^3$ |
| Potassium chloride | Shale inhibition | 56 kg/m$^3$ |
| Substituted triazine | Bactericide | 0.3 kg/m$^3$ |
| Hymod Prima clay | Simulates formation solids | 56 kg/m$^3$ |
| Octanol | Defoamer | 0.2 kg/m$^3$ |
| Barite | Weighting agent | 419 kg/m$^3$ |

Table 2 illustrates the effect of adding Acid Blue 1 to the water-based drilling fluid of Table 1.

TABLE 2

| | | Base Fluid | | Base + 300 g/m$^3$ dye | |
|---|---|---|---|---|---|
| Property | Unit | BHR | AHR | BHR | AHR |
| Density | Lbs/U.S. gallon | 12.0 | 12.0 | 12.0 | 12.0 |
| Plastic viscosity | CP | 24 | 17 | 22 | 19 |
| Yield Point | Lbs/100 sq. ft. | 38 | 36 | 31 | 33 |
| Gel strengths (10 sec/10 min) | Lbs/100 sq. ft. | — | — | 10/13 | 10/13 |
| API Fluid Loss | mLs/30 mins. | 4.2 | 4.8 | 4.3 | 4.6 |
| PH | pH units | — | — | 9.0 | 9.0 |

In Table 2, rheological properties are measured at 50° C. BHR=Before heat aging. AHR=After heat aging in a roller oven for 16 hours at 93° C. Table 2 shows no change in the color of the filtrate was observed after the aging period, demonstrating no significant thermal degradation and no significant adsorption onto solids or metal surfaces.

A typical well requires approximately 800 m$^3$ (5,000 barrels) of drilling mud.

The drilling mud comprising items listed in Table 1 is mixed in a mixing tank located close to the well head. Typically, drilling mud is made by a continuous mixing process, the mixed mud flowing from the mixing tank, into a mud tank or mud pit, and into the well. In the present invention, dye is mixed with the other ingredients by metered flow into the mixing tank to ensure even distribution.

The preferred embodiment of the present invention uses an optical density measurement, measuring reduction of transmitted light, to determine dye concentration. Reduction of transmitted light by absorption of light by the dye is, at low concentrations, essentially proportional to the concentration of the dye. However, scattering also reduces transmitted light in a way that is not indicative of dye concentration. To produce optical density data more purely indicative of absorption, and therefore dye concentration, the method of the present invention preferably includes a technique to filter out the effects of scattering.

To filter out the effects of scattering, a preferred embodiment of the present invention uses two channels, a measurement channel at a first wavelength at which the dye absorbs light strongly, and a reference channel at a second wavelength at which the dye absorbs light weakly, if at all. Optical density as measured by the reference channel (scattering) is subtracted from the optical density as measured by the measurement channel (absorption and scattering). This eliminates the effect of scattering to the extent that scattering is wavelength-independent. To minimize the effects of wavelength-dependent scattering, typically induced by small particles, the measurement channel and the reference channel are close in wavelength.

This dual-channel technique largely eliminates the effect of scattering to produce an optical density more purely indicative of absorption and dye concentration.

Other suitable dyes active in the visible and near-infrared region of the spectrum may be used. One such alternative is Acid Blue 9, alphazurine FG. This dye is sold under the name "Erioglaucine" (product code# 201-009-50) by Keystone Co., Chicago, Ill. A disadvantage of this dye is that it has a tendency to stick to the rock of the formation.

As an alternative to dyes that are active in the visible and near-infrared region of the spectrum, another version of the first embodiment uses a dye that is active in the ultraviolet region of the spectrum In another version, the dye is a fluorescent dye, such as a dye that is excited in the ultraviolet spectrum and emits light in the visible spectrum In this case, the optical analyzer measures fluorescence emission.

In another version, mixed tracers are used, with the optical analyzer measuring at different wavelengths to eliminate errors caused by the susceptibility of one of the tracers to be interfered with by certain components in the connate water.

In another version, in conjunction with the dual-channel technique discussed above, scattering is determined, and a sample is validated if scattering is acceptably low. In U.S. Pat. No. 6,274,865 coloration is used to distinguish crude oil from oil-based mud filtrate. The process is illustrated most particularly in FIG. 12 of the patent.

This process can be adapted to validate samples in the process of the present invention, in which a tracer is used distinguish connate water from water-based mud filtrate.

In another version, asymptotes are computed and a sample is validated if corresponding asymptotes are stable. This version includes testing for stable asymptotes to validate samples. Testing for stable asymptotes is illustrated in the same FIG. 12 of U.S. Pat. No. 6,274,865.

Measuring WBM Filtrate Contamination by Coloration

In a second embodiment, coloration is used to distinguish connate water from water-based mud filtrate. Although connate water and water-based mud filtrate are typically both substantially colorless, and the near-infrared absorption features of different waters often differ only slightly, in some applications this approach is a viable option. Different oil field waters show absorption differences in the UV based largely on variations in the concentrations of organic materials. Most connate waters exhibit very little absorption of visible light, so the maximum OFA path-length of 2 mm may be used along with OFA spectral measurement in the ultraviolet (UV) region of the spectrum. The apparatus for this embodiment includes tungsten-halogen lamps and photodiodes operating in the UV portion of the spectrum.

Measuring WBM Filtrate Contamination by Conductivity or Resistivity

In a third embodiment, conductivity or resistivity is used to distinguish connate water from WBM mud filtrate. Where salinity differences are known to exist, conductivity or resistivity measurement, based respectively on whether the salinity of WBM mud filtrate is greater or less than the salinity of connate water, can also be used to distinguish connate water from water-based mud filtrate using the inventive method.

Measuring WBM Filtrate Contamination by Other Characteristics

In alternative embodiments, other characteristics of downhole fluid indicative of water based mud filtrate contamination levels can be used, including measuring ion concentrations or relative ion concentrations. A Ph sensor, for instance, can be used to determine H+ concentrations, and other types of sensors may be used to determine the ion concentration, or relative ion concentration of other types of ions such as Sodium or Potassium and, correspondingly, levels of water based mud filtrate contamination in the downhole fluid.

What is claimed is:

1. A method for validating a downhole connate water sample drawn from formation surrounding a well, comprising:

drilling the well with a water-based mud containing a water-soluble dye;

obtaining a sample of formation fluid downhole;

measuring optical density of the sample downhole; and validating the sample if sample optical density is acceptably low.

2. A method according to claim 1, further repeating said act of obtaining a sample of formation fluid downhole and said act of measuring optical density of the sample downhole to obtain optical density from each of a series of samples.

3. A method according to claim 1, wherein said water-soluble dye is a blue dye.

4. A method according to claim 1, wherein said water-soluble dye is a dye selected from a group of dyes, the group consisting of Acid Blue #1 (EMI-600) and Acid Blue 9, alphazurine FG.

5. A method according to claim 1, wherein said water-soluble dye is a dye that is active in the ultraviolet region of the spectrum.

6. A method according to claim 1, wherein said water-soluble dye is a fluorescent dye.

7. A method according to claim 1, wherein said water-soluble dye is added to said water-based mud to produce a concentration within the range 0.2–2.0 kg/m$^3$ (200–2000 mg/L).

8. A method according to claim 1, wherein measuring optical density includes measuring optical density at a first wavelength to obtain a first optical density, measuring optical density at a second wavelength to obtain a second optical density, and subtracting said second optical density from said first optical density.

9. A method according to claim 8, wherein said first wavelength and said second wavelength are close in wavelength.

10. A method according to claim 1, further comprising:

determining scattering from a series of optical density values; and validating a sample if the scattering is acceptably low.

11. A method according to claim 1, further comprising:

calculating from a series of optical density values an asymptotic value indicative of water-based mud filtrate fraction; and validating a sample if the asymptotic value is stable.

12. A method for validating a downhole connate water sample drawn from formation surrounding a well, comprising:

drilling the well with a water-based mud;

obtaining a sample of formulation fluid downhole;

measuring at least one characteristic of downhole fluid indicative of water-based mud filtrate contamination levels in the sample; and;

validating the sample if the at least one measured characteristic is acceptably low.

13. A method according to claim 11, wherein said at least one measured characteristic is optical density.

14. A method according to claim 11, wherein said at least one measured characteristic is fluorescence emission, ion concentration, or relative ion concentration.

15. A method according to claim 11, wherein said water-based mud contains a predetermined salt concentration, and wherein said at least one measured characteristic is conductivity or resistivity.

16. A method for determining when to collect a sample of downhole fluid drawn from a formation surrounding a well, comprising:

measuring at least one characteristic of downhole fluid indicative of water-based mud filtrate contamination levels in downhole fluid drawn from a formation surrounding the well over a period of time; and using said measurements to determine when to collect a sample of said downhole fluid.

17. A method according to claim 16, wherein said characteristic is optical density, fluorescence emission, conductivity, resistivity, ion concentration, or relative ion concentration.

18. A method according to claim 16, wherein said water-based mud filtrate contains a water-soluble dye.

* * * * *

UNITED STATES PATENT AND TRADEMARK OFFICE

CERTIFICATE OF CORRECTION

PATENT NO. : 6,729,400 B2
DATED : May 4, 2004
INVENTOR(S) : Mullins et al.

It is certified that error appears in the above-identified patent and that said Letters Patent is hereby corrected as shown below:

Title page,
Item [54], Inventor, should read -- Philip Rabbito --

Signed and Sealed this

Third Day of May, 2005

JON W. DUDAS
*Director of the United States Patent and Trademark Office*